US011096415B2

(12) United States Patent
Thorens

(10) Patent No.: US 11,096,415 B2
(45) Date of Patent: Aug. 24, 2021

(54) HEATED AEROSOL-GENERATING ARTICLE WITH LIQUID AEROSOL-FORMING SUBSTRATE AND COMBUSTIBLE HEAT GENERATING ELEMENT

(71) Applicant: Philip Morris Products S.A., Neuchatel (CH)

(72) Inventor: Michel Thorens, Moudon (CH)

(73) Assignee: Philip Morris Products S.A., Neuchatel (CH)

( * ) Notice: Subject to any disclaimer, the term of this patent is extended or adjusted under 35 U.S.C. 154(b) by 233 days.

(21) Appl. No.: 16/304,754

(22) PCT Filed: May 3, 2017

(86) PCT No.: PCT/EP2017/063060
§ 371 (c)(1),
(2) Date: Nov. 27, 2018

(87) PCT Pub. No.: WO2017/207585
PCT Pub. Date: Dec. 7, 2017

(65) Prior Publication Data

US 2020/0008462 A1 Jan. 9, 2020

(30) Foreign Application Priority Data

May 31, 2016 (EP) ..... 16172277

(51) Int. Cl.
*A24F 47/00* (2020.01)
*A24D 1/22* (2020.01)
*A24B 15/16* (2020.01)

(52) U.S. Cl.
CPC ..... *A24D 1/22* (2020.01); *A24B 15/165* (2013.01)

(58) Field of Classification Search
CPC ..... A24F 47/006; A24D 1/22
See application file for complete search history.

(56) References Cited

U.S. PATENT DOCUMENTS 5,040,551 A 8/1991 Schlatter et al.
5,065,776 A 11/1991 Lawson et al.
(Continued)

FOREIGN PATENT DOCUMENTS

CN 1575135 A 2/2005
CN 101778578 A 7/2010
(Continued)

OTHER PUBLICATIONS

Combined Russian Office Action and Search Report dated Jun. 10, 2020 in Russian Patent Application No. 2018144118 (with English translation), citing document AO therein, 13 pages.
(Continued)

*Primary Examiner* — Eric Yaary
(74) *Attorney, Agent, or Firm* — Oblon, McClelland, Maier & Neustadt, L.L.P.

(57) ABSTRACT

A heated aerosol-generating article is provided, including a plurality of components assembled in the form of a rod, the article having a mouth end and a distal end upstream from the mouth end, and the article further including a combustible heat-generating element disposed at the distal end of the article and configured to heat air drawn into the article, and a liquid aerosol-forming substrate disposed downstream of the combustible heat-generating element.

11 Claims, 2 Drawing Sheets

(56) References Cited

U.S. PATENT DOCUMENTS

| | | | | |
|---|---|---|---|---|
| 2009/0065011 | A1* | 3/2009 | Maeder | A24F 47/006 131/194 |
| 2009/0095311 | A1 | 4/2009 | Han | |
| 2011/0041861 | A1 | 2/2011 | Sebastian et al. | |
| 2012/0255569 | A1* | 10/2012 | Beard | A24D 3/10 131/334 |
| 2012/0298123 | A1* | 11/2012 | Woodcock | A24F 47/006 131/328 |
| 2013/0233329 | A1 | 9/2013 | Sebastian et al. | |
| 2013/0269720 | A1 | 10/2013 | Stone et al. | |
| 2014/0261486 | A1* | 9/2014 | Potter | A24F 40/40 131/328 |
| 2015/0122273 | A1* | 5/2015 | Mironov | A24C 5/00 131/328 |
| 2015/0313281 | A1 | 11/2015 | Bonici et al. | |
| 2016/0295909 | A1 | 10/2016 | Besso et al. | |
| 2017/0055576 | A1* | 3/2017 | Beeson | A24D 1/02 |

FOREIGN PATENT DOCUMENTS

| | | | |
|---|---|---|---|
| CN | 203538357 | U | 4/2014 |
| CN | 103932401 | A | 7/2014 |
| CN | 104126878 | A | 11/2014 |
| CN | 104379004 | A | 2/2015 |
| CN | 105212277 | A | 1/2016 |
| EP | 2 412 395 | A1 | 2/2012 |
| JP | 2-283271 | | 11/1990 |
| JP | 4-246365 | | 9/1992 |
| JP | 2013-502232 | | 1/2013 |
| JP | 2015-527073 | | 9/2015 |
| RU | 2 328 192 | C1 | 7/2008 |
| WO | WO 2009/022232 | A2 | 2/2009 |
| WO | WO 2013/120855 | A1 | 8/2013 |
| WO | WO 2014/140273 | A2 | 9/2014 |
| WO | WO 2015/101511 | A1 | 7/2015 |

OTHER PUBLICATIONS

International Search Report and Written Opinion dated Sep. 22, 2017 in PCT/EP2017/063060, filed May 30, 2017.

Office Action dated Oct. 9, 2020 in corresponding Russian Patent Application No. 2018144118 (with English Translation), citing documents AA and AO therein, 11 pages.

Chinese Office Action dated Feb. 20, 2021 in corresponding Chinese Patent Application No. 201780030308.2 (with English translation), citing documents AO-AU therein, 17 pages.

Japanese Office Action dated Jun. 3, 2021 in corresponding Japanese Patent Application No. 2018-560035 (with English translation), 9 pages.

* cited by examiner

HEATED AEROSOL-GENERATING ARTICLE WITH LIQUID AEROSOL-FORMING SUBSTRATE AND COMBUSTIBLE HEAT GENERATING ELEMENT

The present invention relates to a heated aerosol-generating article comprising an aerosol-forming substrate and a combustible heat-generating element and a method for forming such a heated aerosol-generating article.

Recent years have seen the emergence of two main categories of heated aerosol-generating systems that produce an inhalable aerosol by heating rather than by burning an aerosol-forming substrate. One system, which may be described as an e-cigarette system, typically comprises a liquid aerosol-forming substrate contained within a cartridge of an atomiser unit. On operation, liquid is conveyed from the cartridge by a wick and is vaporised by a heating coil. A second system, which may be described as a heated tobacco system, involves the heating of a solid substrate comprising modified tobacco to produce an inhalable aerosol.

One known type of heated tobacco system comprises a consumable article comprising a combustible heat generating element and generates an aerosol by the transfer of heat from a combustible heat-generating element to a solid aerosol-forming substrate located adjacent to the combustible heat-generating element. During aerosol-generation, volatile compounds are released from the solid aerosol-forming substrate by heat transfer from the combustible heat-generating element and entrained in air drawn through the heated aerosol-generating article. As the released compounds cool, they condense to form an aerosol that is inhaled by the user.

There are advantages and disadvantages of both main categories of heated aerosol-generating systems. One disadvantage of the e-cigarette system is that direct heating of the liquid substrate with a heating coil risks overheating of the liquid, particularly when the cartridge is near to empty. A further issue with a typical e-cigarette system is that the device may be used by multiple users and come into contact with many external contaminants. This provides a potential hygiene issue.

A heated tobacco system using a consumable article containing a solid aerosol-forming substrate may produce a sensorially more acceptable aerosol and does not have the same hygiene problems associated with e-cigarettes. A user may desire the wider variety of flavours that are possible with a liquid-based heated e-cigarette system, however.

According to a first aspect of the invention, there is provided, a heated aerosol-generating article comprising a plurality of components assembled in the form of a rod. The article has a mouth end and a distal end upstream from the mouth end. The article comprises a combustible heat-generating element located at the distal end of the article for heating air drawn into the article, and a liquid aerosol-forming substrate located downstream of the combustible heat-generating element.

Preferably, the liquid aerosol-forming substrate is releasably contained within the frangible capsule and the liquid retention medium is located in proximity to the frangible capsule for retaining the liquid aerosol-forming substrate within the article after its release from the frangible capsule.

The liquid aerosol-forming substrate may, alternatively, be incorporated into the liquid retention medium immediately prior to use. For example, a dose of liquid aerosol-forming substrate may be injected into the liquid retention medium immediately prior to use.

The heated aerosol-generating article is a consumable that may be consumed by igniting the combustible heat-generating element. The article is preferably used once and then disposed of. A method of using the heated aerosol-generating article may comprise the steps of igniting the combustible heat-generating element with an external heat source and drawing air through the heated aerosol-generating article. Liquid aerosol-forming substrate retained within the aerosol-generating article is then vaporised by heat energy supplied by the combustible heat-generating element and condenses to form an aerosol entrained in the air. When the use is over, for example when the aerosol-forming substrate or the combustible heat-generating element has been has been consumed, the article may be disposed of. A preferred method may comprise steps of releasing the liquid aerosol-forming substrate from a frangible capsule such that it is retained by the liquid retention medium of the article, igniting the combustible heat-generating element with an external heat source, and drawing air through the article, the liquid aerosol-forming substrate being vaporised by heat energy supplied by the combustible heat-generating element and condensing to form an aerosol entrained in the air.

Preferably, the combustible heat-generating element heats air that is drawn into the heated aerosol-generating article, the heated air passing over or through the liquid retention medium of the article to vaporise the liquid aerosol-forming substrate and allow formation of an aerosol. It is preferred that air is heated to a temperature of about 200° C. to 220° C. before passing over or through the liquid retention medium. Preferably, the air with entrained volatile components subsequently cools to a temperature of about 100° C. within the article, allowing the volatile components to condense and form an aerosol. The combustible heat-generating element may alternatively heat the liquid retention medium by conduction or radiation in order to vaporise the liquid aerosol-forming substrate and allow formation of an aerosol.

As the article is intended to be disposed after a single use, the hygiene issues that may be associated with typical e-cigarette systems are overcome. Furthermore, the liquid aerosol-forming substrate does not directly contact a heating element and, thus, problems with overheating of the aerosol-forming substrate do not occur. Articles may be produced with a wide range of different liquid aerosol-forming substrate compositions, thereby providing the user with the wide range of flavours and experiences that can be provided by e-cigarette systems.

As used herein, the term "heated aerosol-generating article" refers to an article comprising an aerosol-forming substrate that is intended to be heated rather than combusted in order to release volatile compounds that can form an aerosol. The aerosol formed by heating the aerosol-forming substrate may contain fewer known harmful constituents than would be produced by combustion or pyrolytic degradation of the aerosol-forming substrate.

As used herein, the term "aerosol-forming substrate" refers to a substrate capable of releasing volatile compounds that can form an aerosol. An aerosol-forming substrate may be solid or liquid or comprise both solid and liquid components.

As used herein, the term "liquid aerosol-forming substrate" refers to an aerosol-forming substrate that is in a liquid rather than a solid form. A liquid aerosol-forming substrate may be at least partially absorbed by a liquid retention medium. A liquid-aerosol-forming substrate includes an aerosol-forming substrate in the form of a gel.

As used herein, the term "mouth end" refers to a portion of the heated aerosol-generating article where aerosol exits the article and is delivered into a user's mouth. In use, a user may draw on the mouth end of the article in order to inhale aerosol generated by the heated aerosol-generating article.

As used herein, the term "distal end" refers to an end of the article that opposes the mouth end.

As used herein, the terms "upstream" and "downstream" are used to describe the relative positions of components, or portions of components, of the heated aerosol-generating article in relation to the direction that air is drawn through the article during use. The mouth end of the article may also be referred to as the downstream end and the distal end of the article may also be referred to as the upstream end. Components, or portions of components, of the article may be described as being upstream or downstream of one another based on their relative positions between the mouth or downstream end and the distal or upstream end.

As used herein, the term 'longitudinal' is used to describe the direction between the upstream end and the downstream end of the aerosol-generating article, and the term 'transverse' is used to describe the direction perpendicular to the longitudinal direction.

As used herein, the term 'diameter' is used to describe the maximum dimension in the transverse direction of the aerosol-generating article. As used herein, the term 'length' is used to describe the maximum dimension in the longitudinal direction.

As used herein, the term "liquid retention medium" refers to a component that is capable of releasably retaining a liquid aerosol-forming substrate. The liquid retention medium may be, or may comprise, a porous or fibrous material that absorbs or otherwise retains a liquid aerosol-forming substrate that it is brought into contact with while allowing the liquid aerosol-forming substrate to be released by vaporisation.

As used herein, the term "frangible capsule" refers to a capsule that is capable of containing a liquid aerosol-forming substrate and releasing the liquid aerosol-forming substrate when broken or ruptured. The frangible capsule may be formed from, or comprise, a brittle material that is easily broken by a user to release its liquid aerosol-forming substrate contents. For example the capsule may be broken by external force, such as finger pressure.

The heated aerosol-generating article may be substantially cylindrical in shape. The aerosol-generating article may be substantially elongate. The aerosol-generating article may have a length and a circumference substantially perpendicular to the length. The liquid retention medium may be substantially cylindrical in shape. The liquid retention medium may be substantially elongate. The liquid retention medium may also have a length and a circumference substantially perpendicular to the length.

The aerosol-generating article may have an external diameter of between approximately 5 millimetres and approximately 12 millimetres, for example of between approximately 6 millimetres and approximately 8 millimetres. In a preferred embodiment, the aerosol-generating article has an external diameter of 7.2 millimetres+/−10 percent.

The aerosol-generating article may have a total length between approximately 25 mm and approximately 150 mm. In one specific embodiment, the aerosol-generating article has a total length of approximately 85 mm. In another specific embodiment, the aerosol-generating article has a total length of approximately 65 mm.

The combustible heat-generating element may have a length of between about 7 mm and about 20 mm, for example between 8 mm and 15 mm. In one embodiment, the liquid retention medium may have a length of approximately 10 mm.

The liquid retention medium may have a length of between about 7 mm and about 20 mm, for example between 8 mm and 15 mm. In one embodiment, the liquid retention medium may have a length of approximately 10 mm.

The combustible heat-generating element and the liquid retention medium preferably have an external diameter that is approximately equal to the external diameter of the aerosol-generating article. The external diameter may be between approximately 5 mm and approximately 12 mm. In one embodiment, the external diameter may be approximately 7.2 mm+/−10 percent.

The heated aerosol-generating article may comprise a plurality of components assembled by, or circumscribed by, a wrapper in the form of a rod. For example, the article may comprise the combustible heat source, the liquid retention medium, and a mouthpiece located downstream of the liquid retention medium.

The mouthpiece may be located at the mouth end of the article. The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece preferably has an external diameter that is approximately equal to the external diameter of the aerosol-generating article. The mouthpiece may have an external diameter of a diameter of between approximately 5 millimetres and approximately 10 millimetres, for example of between approximately 6 millimetres and approximately 8 millimetres. In a preferred embodiment, the mouthpiece has an external diameter of 7.2 millimetres+/−10%.

The mouthpiece may have a length of between approximately 5 millimetres and approximately 20 millimetres. For example, the mouthpiece may have a length of from about 7 mm to about 12 mm.

The article may comprise a porous or air-permeable plug located between the liquid retention medium and the combustible heat source. Such a plug may act to help retain the liquid aerosol-forming substrate within the article. The plug may have an external diameter of between approximately 5 millimetres and approximately 10 millimetres, for example of between approximately 6 millimetres and approximately 8 millimetres. In a preferred embodiment, the plug has an external diameter of 7.2 millimetres+/−10%.

The plug may have a length of between approximately 2 millimetres and approximately 10 millimetres. For example, the mouthpiece may have a length of from about 3 mm to about 5 mm.

The article may comprise an aerosol-forming section or an aerosol-cooling section. The plurality of components may be co-axially aligned and assembled within the wrapper. The wrapper may be a traditional cigarette paper. The wrapper may be a polymeric film or a coated paper.

The liquid retention medium preferably comprises an absorbent material, for example an absorbent polymeric material. Examples of suitable liquid retention materials include fibrous polymers and porous polymers such as open-cell foams. The liquid retention medium may comprise a fibrous cellulose acetate or a fibrous cellulose polymer. The liquid retention medium may comprise a porous polypropylene material. Suitable materials capable of retaining a liquid will be known to the skilled person.

The liquid retention medium is either located within an air-flow path through the heated aerosol-generating article or defines at least a portion of an air-flow path through the aerosol-generating article. Preferably, one or more holes defined through the liquid retention medium define a portion of the air-flow path through the heated aerosol-generating article between the distal end of the article and the mouth end of the article.

The liquid retention medium may be in the form of a tube having a central lumen. Walls of the tube would then be formed from, or comprise, a suitable liquid-retention material.

The heated aerosol-generating article may comprise a liquid aerosol-forming substrate contained within a frangible capsule. The frangible capsule is preferably spheroid, for example spherical or ovoid, having a maximum dimension of between 2 mm and 8 mm, for example between 4 mm and 6 mm. The frangible capsule may contain a volume of between 20 and 300 microlitres, for example between 30 and 200 microlitres. Such a range may provide between 10 and 150 puffs of aerosol to a user.

It is preferred that the liquid retention medium is capable of absorbing between 105% and 110% of the total volume of liquid contained within the frangible capsule. This helps to prevent leakage of liquid aerosol-forming substrate from the article after the frangible capsule has been broken to release its contents. It is preferred that the liquid retention medium is between 90% and 95% saturated after release of the liquid aerosol-forming substrate from the frangible capsule.

The frangible capsule may have a brittle shell, or may be shaped to facilitate rupture when subjected to external force. The frangible capsule may be configured to be ruptured by application of external force. For example, the frangible capsules may be configured to rupture at a specific defined external force, thereby releasing the liquid-aerosol-forming substrate. The frangible capsule may be configured with a weakened or brittle portion of its shell to facilitate rupture. The frangible capsule may be arranged for engagement with a piercing element for breaking the capsule and releasing the liquid aerosol-forming substrate. Preferably the frangible capsule has a burst strength of between about 0.5 and 2.5 kilograms force (kgf), for example between 1.0 and 2.0 kgf.

The shell of the frangible capsule may comprise a suitable polymeric material, for example a gelatin based material. The shell of the capsule may comprise a cellulose material or a starch material.

The frangible capsule may be located adjacent to the liquid retention medium within the article such that the liquid-aerosol-forming substrate released from the frangible capsule can contact and be retained by the liquid retention medium. The frangible capsule may be located within the liquid retention medium. For example, the liquid retention medium may be in the form of a tube having a lumen and the frangible capsule containing the liquid aerosol-forming substrate may be located within the lumen of the tube.

The heated aerosol-generating article may comprise an aerosol generation section located downstream of the liquid retention medium. In use, the liquid aerosol-forming substrate is vaporised and volatile components of the substrate are drawn downstream from the liquid retention medium. The volatile components then cool in the aerosol forming section to form the inhalable aerosol. The aerosol forming section may be defined by a space within the article, or by the lumen of a tube within the article. The aerosol forming section may include an aerosol-cooling element, for example an aerosol-cooling element comprising a gathered sheet of polymeric material.

An aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length.

The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters). In a particularly preferred embodiment, the aerosol-cooling element comprises a gathered sheet of polylactic acid.

The aerosol-cooling element may be formed from a gathered sheet of material having a specific surface area of between approximately 10 square millimetres per milligram and approximately 100 square millimetres per milligram weight. In some embodiments, the aerosol-cooling element may be formed from a gathered sheet of material having a specific surface area of approximately 35 mm2/mg.

The liquid aerosol-forming substrate comprises water. Preferably, the liquid aerosol-forming substrate also comprises an aerosol-former such as propylene glycol or glycerine. The liquid aerosol-forming substrate preferably comprises a flavourant. The liquid aerosol-forming substrate may further comprise an active ingredient such as nicotine. Preferably the liquid-aerosol-forming substrate has a water content of between 10 and 25 weight percent, for example between 12 and 20 weight percent. Water is required to form a suitable inhalable aerosol. The liquid aerosol-forming substrate may comprise a nicotine solution. The liquid aerosol-forming substrate preferably comprises a tobacco-containing material comprising volatile tobacco flavour compounds which are released from the liquid upon heating. The liquid aerosol-forming substrate may comprise a non-tobacco material. The liquid aerosol-forming substrate may include solvents, ethanol, plant extracts and natural or artificial flavours.

As used herein, the term "aerosol-former" refers to any suitable known compound or mixture of compounds that, in use, facilitates formation of a dense and stable aerosol. An aerosol-former is substantially resistant to thermal degradation at the operating temperature of the aerosol-generating article. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine.

In a preferable heated aerosol-generating article, an airflow path is defined through the heated aerosol-generating article. The air flow path include a point at which air enters the aerosol-generating article, a point at which air passes over the liquid retention medium, and a point at which air passes out of the mouth end of the heated aerosol-generating article and into a user's mouth. In a preferable article, the aerosol-generating article acts to heat air at a point between entry into the aerosol-generating article and passing over the liquid retention medium. This allows heated air to vaporise a liquid aerosol-forming substrate retained by the liquid retention medium. Heating of the air may be accomplished by a heater such as a heating coil that is located within the airflow path and acts to directly heat the air prior to that air passing over the liquid retention medium.

The heated aerosol-generating article may also comprise a heat diffuser. The heat diffuser may be arranged in the airflow path of the article. The heat diffuser may be in thermal contact with the combustible heat-generating element. The heat diffuser may be arranged between the combustible heat-generating element and the liquid retention medium.

The heat diffuser may comprise an air permeable heat accumulator or heat diffuser that is arranged in the air flow path to heat air. The term heat diffuser is used below. The heat diffuser may interact with a heater and take on heat energy. The heat energy is then passed to air passing through the heat diffuser. A heat diffuser is preferably a component having a high surface area and high porosity. Air should be able to flow through the heat diffuser without undergoing a significant pressure drop. Examples of suitable heat diffusers may be a porous metallic foam or a porous ceramic foam component arranged both in thermal contact with a heater and within the air flow path of the heated aerosol-generating article.

The heat diffuser may comprise a non-combustible porous body for absorbing heat from the combustible heat-generating element such that, in use, air drawn through the aerosol-generating article from the distal end to the mouth end is heated by the heat absorbed in the porous body.

As used herein, the term "porous" is intended to encompass materials that are inherently porous as well as substantially non-porous materials that are made porous or permeable through the provision of a plurality of holes. The porous body may be formed from a plug of porous material, for example a ceramic or metal foam. Alternatively, the porous body may be formed from a plurality of solid elements between which a plurality of apertures are provided. For example, the porous body may comprise a bundle of fibres, or a lattice of interconnected filaments. The porous material must have pores of a sufficient size that air can be drawn through the porous body through the pores. For example, the pores in the porous body may have an average transverse dimension of less than about 3.0 mm, more preferably less than about 1.0 mm, most preferably less than about 0.5 mm. Alternatively or in addition, the pores may have an average transverse dimension that is greater than about 0.01 mm. For example, the pores may have an average transverse dimension that is between about 0.01 mm and about 3.0 mm, more preferably between about 0.01 mm and about 1.0 mm, and most preferably between about 0.01 mm and about 0.5 mm.

As used herein, the term "pores" relates to regions of a porous article that are devoid of material. For example, a transverse area of porous body will comprise portions of the material forming the body and portions that are voids between the portions of material.

The average transverse dimension of the pores is calculated by taking the average of the smallest transverse dimension of each of the pores. The pore sizes may be substantially constant along the length of the porous body. Alternatively, the pore sizes may vary along the length of the porous body.

As used herein, the term "transverse dimension" refers to a dimension that is in a direction which is substantially perpendicular to the longitudinal direction of the heated aerosol-generating article.

The porosity distribution of the porous body may be substantially uniform. That is, the pores within the porous body may be distributed substantially evenly over the transverse area of the porous body. The porosity distribution may differ across the transverse area of the porous body. That is, the local porosity in one or more sub-areas of the transverse area may be greater than the local porosity in one or more other sub-areas of the transverse area. For example, the local porosity in one or more sub-areas of the transverse area may be between 5 percent and 80 percent greater than the local porosity in one or more other sub-areas of the transverse area. This may enable a flow of air through the porous body to be As used herein, the term "transverse area" relates to an area of the porous body that is in a plane generally perpendicular to the longitudinal dimension of the porous body. For example, the porous body may be a rod and the transverse area may be a cross-section of the rod taken at any length along the rod, or the transverse area may be an end face of the rod.

As used herein, the term "porosity" refers to the volume fraction of void space in a porous article. As used herein, the term "local porosity" refers to the fraction of pores within a sub-area of the porous body.

By varying the porosity distribution, air flow through the porous body may be altered as desired, for example to provide improved aerosol characteristics. For example, this porosity distribution may be varied according to the air flow characteristics of an aerosol-generating article, or the temperature profile of the combustible heat-generating element.

In some examples, the local porosity may be lower towards a centre portion of the porous body. With this arrangement, the air flow through the centre portion of the porous body is decreased relative to the periphery of the porous body. This may be advantageous depending on the temperature profile of the combustible heat-generating element or on the airflow characteristics of the aerosol-generating article.

In other examples, the local porosity may be greater towards a centre portion of the porous body. This arrangement may enable increased air flow through the centre of the porous body and may be advantageous depending on the temperature profile of the combustible heat-generating element or on the airflow characteristics of the aerosol-generating article.

As porous bodies have a high surface-area-to-volume ratio, the heat diffuser may allow quick and efficient heating of air drawn through the porous body. This may allow for homogenous heating of air drawn through the porous body and, consequently, more even heating of an aerosol-forming substrate downstream of the heat diffuser.

In preferred embodiments, the porous body has a surface area-to-volume ratio of at least 20 to 1, preferably at least 100 to 1, more preferably of at least 500 to 1. Advantageously, this may provide a compact heat diffuser while allowing for particularly efficient transfer of thermal energy from the combustible heat-generating element to air drawn through the porous body. This may lead to quicker, and homogenous heating of air drawn through the porous body and, consequently, more even heating of an aerosol-forming substrate downstream of the heat diffuser relative to porous bodies having lower surface area to volume ratios.

In preferred embodiments, the porous body has a high specific surface area. This is a measure of the total surface area of a body per unit of mass. Advantageously, this may provide a low mass heat diffuser with a large surface area for efficient transfer of thermal energy from the combustible heat-generating element to air drawn through the porous body. For example, the porous body may have a specific surface area of at least 0.01 m2 per gram, preferably at least 0.05 m2 per gram, more preferably at least 0.1 m2 per gram, most preferably at least 0.5 m2 per gram.

The porous body preferably has an open cell porosity of between about 60 percent to about 90 percent void volume to material volume.

In some embodiments, the porous body has a low resistance to draw. That is, the porous body may offer a low resistance to the passage of air through the heat diffuser. In such examples, the porous body does not substantially affect the resistance to draw of an aerosol-generating article. In some embodiments, the resistance to draw (RTD) of the porous body is between about 10 to 130 mm H2O, preferably between about 40 to 100 mm H2O. The RTD of a specimen refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation blocked.

The porous body may be formed from a heat storage material.

As used herein, the term "heat storage material" refers to a material having a high heat capacity. With this arrangement, the porous body may act as a heat reservoir, allowing the heat diffuser to absorb and store heat from the combustible heat-generating element and to subsequently release the heat over time to the aerosol-forming substrate, via air drawn through the porous body.

Where the porous body is formed from a heat storage material, preferably, the porous body is formed from a material having a specific heat capacity of at least 0.5 J/g·K, preferably at least 0.7 J/g·K, more preferably at least 0.8 J/g·K at 25 degrees Celsius and constant pressure. As the specific heat capacity of a material is effectively a measure of the material's ability to store thermal energy, forming the porous body from a material having a high heat capacity may allow the porous body to provide a large heat reservoir for heating air drawn through the heat diffuser without substantially increasing the weight of an aerosol-generating article.

The porous body may be formed from any suitable material or materials. Where the porous body is formed from a heat storage material, suitable materials include, but are not limited to, glass fibre, glass mat, ceramic, silica, alumina, carbon, and minerals, or any combination thereof.

The heat storage material may be thermally insulating. As used herein, the term "thermally insulating" refers to a material having a thermal conductivity of less than 100 W/m·K, preferably less than 40 W/m·K, or less than 10 W/m·K at 23 degrees Celsius and a relative humidity of 50%. This may result in a heat diffuser with a higher thermal inertia relative to thermally conductive heat diffusers to reduce variations in the temperature of air drawn through the porous body caused by temperature fluctuations in the combustible heat-generating element. This may result in more consistent aerosol characteristics.

The porous body may be thermally conductive. As used herein, the term "thermally conductive" refers to a material having a thermal conductivity of at least 10 W/m·K, preferably at least 40 W/m·K, more preferably at least 100 W/m·K at 23 degrees Celsius and a relative humidity of 50%. Where the porous body is thermally conductive, preferably, the porous body is formed from a material having a thermal conductivity of at least 40 W/m·K, preferably at least 100 W/m·K, more preferably at least 150 W/m·K, and most preferably at least 200 W/m·K at 23 degrees Celsius and a relative humidity of 50%.

Advantageously, this may reduce the thermal inertia of the heat diffuser and allow the temperature of the heat diffuser to quickly adjust to changes in the temperature of the combustible heat-generating element. Further, by having a high thermal conductivity, the thermal resistance through the porous body will be lower. This may allow the temperature of portions of the porous body which are remote from the combustible heat-generating element in use to be at a similarly high temperature as the portions of the porous body which are closest to the combustible heat-generating element in use. This may provide for particularly efficient heating of air drawn through the porous body.

Where the porous body is thermally conductive, preferably, the porous body is formed from a material having a thermal conductivity of at least 40 W/m·K, preferably at least 100 W/m·K, more preferably at least 150 W/m·K, most preferably at least 200 W/m·K at 23 degrees Celsius and a relative humidity of 50%.

Where the porous body is thermally conductive, suitable thermally conductive materials include, but are not limited to, aluminium, copper, zinc, steel, silver, thermally conductive polymers, or any combination or alloy thereof.

In some embodiments, the porous body is formed from a heat storage material which is also thermally conductive, such as aluminium.

The heat diffuser may be heated by the combustible heat-generating element and heat air that passes through the heat diffuser element. The heated air may then volatilize an aerosol-forming substrate of the heated aerosol-generating article that is located downstream of the heat diffuser. In this way the manner in which the aerosol-generating article heats an aerosol-forming substrate may be changed from primarily via direct contact with the combustible heat-generating element to indirect heating through heating of air.

The heat diffuser may have a length of between about 7 mm and about 20 mm, for example between 8 mm and 15 mm. In one embodiment, the heat diffuser may have a length of approximately 10 mm.

The heat diffuser preferably has an external diameter that is approximately equal to the external diameter of the aerosol-generating article. The heat diffuser may have an external diameter of a diameter of between approximately 5 millimetres and approximately 10 millimetres, for example of between approximately 6 millimetres and approximately 8 millimetres. In a preferred embodiment, the heat diffuser has an external diameter of 7.2 millimetres+/−10%.

In some embodiments of the invention, the heat diffuser may comprise a body of solid aerosol-forming substrate. The solid aerosol-forming substrate may comprise a tobacco-containing material containing volatile tobacco flavour compounds which are released from the substrate upon heating. The solid aerosol-forming substrate may comprise a non-tobacco material. The solid aerosol-forming substrate may comprise tobacco-containing material and non-tobacco containing material.

The solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

The solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

The solid aerosol-forming substrate may comprise a homogenised tobacco material. As used herein, the term 'homogenised tobacco material' refers to a material formed by agglomerating particulate tobacco.

The solid aerosol-forming substrate may comprise a gathered textured sheet of homogenised tobacco material. The solid aerosol-forming substrate may comprise a gathered textured sheet of homogenised tobacco material comprising one or more of a plurality of spaced-apart indentations, protrusions and perforations. Use of a textured sheet of homogenised tobacco material may facilitate gathering of the sheet of homogenised tobacco material to form the solid aerosol-forming substrate. As used herein, the term 'sheet' refers to a laminar element having a width and length substantially greater than a thickness. As used herein, the term 'gathered' is used to describe a sheet that is convoluted, folded, or otherwise compressed or constricted substantially transversely to a longitudinal axis of the solid aerosol-forming substrate. As used herein, the term 'textured sheet' denotes a sheet that has been crimped, embossed, debossed, perforated or otherwise deformed.

The solid aerosol-forming substrate may comprises a gathered crimped sheet of homogenised tobacco material. As used herein, the term 'crimped sheet' refers to a sheet having a plurality of substantially parallel ridges or corrugations. Preferably, the substantially parallel ridges or corrugations extend along or parallel to a longitudinal axis of the solid aerosol-forming substrate. This may facilitate gathering of the crimped sheet of homogenised tobacco material to form the solid aerosol-forming substrate. However, it will be appreciated that crimped sheets of homogenised tobacco material for inclusion in the solid aerosol-forming substrate may alternatively or in addition have a plurality of substantially parallel ridges or corrugations that are disposed at an acute or obtuse angle to the longitudinal axis of the solid aerosol-forming substrate.

The solid aerosol-forming substrate may be heated by the combustible heat-generating element and heat air that passes through the solid aerosol-forming substrate. Volatile compounds of the heated solid aerosol-forming substrate may also be vapourised. The heated air and vapour may then heat and volatilize the liquid aerosol-forming substrate retained in the liquid retention medium that is located downstream of the solid aerosol-forming substrate. This may generate an aerosol that is sensorially preferably to an aerosol generated solely from a liquid aerosol-forming substrate.

The solid aerosol-forming substrate may be circumscribed by a filer plug wrap.

The combustible heat-generating element may be a carbonaceous heat-generating element. As used herein, the term 'carbonaceous' is used to describe a combustible heat-generating element comprising carbon. Preferably, combustible carbonaceous heat-generating elements for use in aerosol-generating articles according to the invention have a carbon content of at least about 35 percent, more preferably of at least about 40 percent, most preferably of at least about 45 percent by dry weight of the 30 combustible heat-generating element.

The combustible heat-generating element according to the present invention may be a combustible carbon-based heat-generating element. As used herein, the term 'carbon-based heat-generating element' is used to describe a combustible heat-generating element comprised primarily of carbon.

Combustible carbon-based heat-generating elements for use in aerosol-generating articles according to the invention may have a carbon content of at least about 50 percent, preferably of at least about 60 percent, more preferably of at least about 70 percent, most preferably of at least about 80 percent by dry weight of the combustible carbon-based combustible heat-generating element.

The heated aerosol-generating article of the present invention may comprise one or more airflow pathways along which air may be drawn through the heated aerosol-generating article for inhalation by a user. As used herein the terms 'upstream' and 'downstream' are used to describe relative directions and positions of components of the heated aerosol-generating article in relation to the direction air flows through the one or more airflow pathways when a user draws on the heated aerosol-generating article.

The combustible heat-generating element may be isolated from the one or more airflow pathways such that, in use, air drawn through the heated aerosol-generating article along the one or more airflow pathways does not directly contact the combustible heat-generating element.

Isolation of the combustible heat-generating element from the one or more airflow pathways of the heated aerosol-generating article may substantially prevent or inhibit activation of combustion of the combustible heat-generating element during puffing by a user. This may substantially prevent or inhibit spikes in the temperature of the aerosol-forming substrate during puffing by a user on the heated aerosol-generating article. This may substantially prevent or inhibit combustion or pyrolysis of the aerosol-forming substrate under intense puffing regimes. This may substantially prevent or inhibit changes in the composition of the aerosol generated by the heated aerosol-generating article due to a user's puffing regime.

Isolation of the combustible heat-generating element from the one or more airflow pathways may also substantially prevent or inhibit combustion and decomposition products, and other materials formed during ignition and combustion of the combustible heat-generating element, from entering air drawn through the heated aerosol-generating article along the one or more airflow pathways.

The isolated combustible heat-generating element may comprise a blind combustible heat-generating element. As used herein, the term 'blind' is used to describe a combustible heat-generating element in which air drawn through the heated aerosol-generating article for inhalation by a user does not pass through an airflow channel along the combustible heat-generating element. As such, heat transfer between the blind combustible heat-generating element and the aerosol-forming substrate occurs predominantly by conductive heat transfer.

By not providing airflow channels through the combustible heat-generating element, convective heat transfer between the combustible heat-generating element and the aerosol-forming substrate is reduced or minimised. Reducing convective heat transfer between the combustible heat-generating element and the aerosol-forming substrate may substantially prevent or inhibit spikes in the temperature of the aerosol forming substrate during puffing by a user. This may substantially prevent or inhibit combustion or pyrolysis of the aerosol-forming substrate under intense puffing regimes. This may substantially prevent or inhibit changes in the composition of the aerosol generated by the heated aerosol-generating article due to a user's puffing regime. This may also substantially prevent or inhibit combustion and decomposition products, and other materials formed during ignition and combustion of the combustible heat-generating element, from entering air drawn through the heated aerosol-generating article along the one or more airflow pathways.

The heated aerosol-generating article may comprise one or more air inlets between a proximal end of the combustible heat-generating element and a proximal end of the heated aerosol-generating article. The one or more air inlets may be arranged such that air may be drawn into the one or more airflow pathways of the heated aerosol-generating article, though the one or more air inlets, without being drawn through the combustible heat-generating element. This may substantially prevent or inhibit spikes in the temperature of the aerosol-forming substrate during puffing by a user.

The one or more air inlets may comprise any suitable air inlets through which air may be drawn into the heated aerosol-generating article. For example, suitable air inlets include holes, slits, slots or other apertures. The number, shape, size and arrangement of the air inlets may be suitably adjusted to achieve a good aerosol-generating performance.

The one or more air inlets may be arranged at any location between the proximal end of the combustible heat-generating element and the proximal end of the heated aerosol-generating article. The one or more air inlets may be arranged at the liquid aerosol-forming substrate. The one or more air inlets may be arranged at the heat diffuser. The one or more air inlets may be arranged between a distal end of the aerosol-forming substrate and a proximal end of the aerosol-forming substrate. The one or more openings may be slits, slots or other suitable apertures through which air may be drawn into the heated aerosol-generating article. The number, shape, size and arrangement of the openings may be suitably adjusted to achieve a good aerosol-generating performance.

The heated aerosol-generating article may further comprise a non-combustible, substantially air impermeable, first barrier between the combustible heat-generating element and the aerosol-forming substrate. The first barrier may facilitate isolation of the combustible heat-generating element from the one or more airflow pathways of the heated aerosol-generating article.

As used herein, the term 'non-combustible' is used to describe a barrier that is substantially non-combustible at temperatures reached by the combustible heat-generating element during combustion or ignition thereof. As used herein, the term 'air impermeable' is used to describe a barrier that substantially prevents or inhibits the passage of air therethrough.

The first barrier may abut one or both of the proximal end of the combustible heat-generating element and the distal end of the component adjacent to the combustible heat source. The first barrier may be adhered or otherwise affixed to one or both of the proximal end of the combustible heat-generating element and the distal end of the adjacent component. The first barrier may abut the distal end of the liquid retention medium. The first barrier may abut the distal end of the heat diffuser.

The first barrier may comprise a first barrier coating provided on a proximal face of the combustible heat-generating element. In such embodiments, the first barrier may comprise a first barrier coating provided on at least substantially the entire proximal face of the combustible heat-generating element. The first barrier may comprise a first barrier coating provided on the entire proximal face of the combustible heat-generating element. The first barrier coating may be formed and applied to the proximal face of the combustible heat-generating element by any suitable method, such as the methods described in WO-A1-2013120855.

Depending upon the desired characteristics and performance of the heated aerosol-generating article, the first barrier may have a low thermal conductivity or a high thermal conductivity. In certain embodiments, the first barrier may have a thermal conductivity of between about 0.1 W/m·K and about 200 W/m·K.

The first barrier may be formed from one or more suitable materials that are substantially thermally stable and non-combustible at temperatures achieved by the combustible heat-generating element during ignition and combustion. Suitable materials are known in the art and include, but are not limited to, clays (such as, for example, bentonite and kaolinite), glasses, minerals, ceramic materials, resins, metals and combinations thereof. Materials from which the first barrier may be formed include clays and glasses. More materials from which the first barrier may be formed include copper, aluminium, stainless steel, alloys, alumina ($Al_2O_3$), resins, and mineral glues.

Where the first barrier comprises a metal or an alloy, such as copper, aluminium, stainless steel, the first barrier coating may advantageously act as a thermal link between the combustible heat-generating element and the adjacent component. This may improve conductive heat transfer from the combustible heat-generating element to the liquid aerosol-forming substrate. This may improve conductive heat transfer from the combustible heat-generating element to the heat diffuser.

The heated aerosol-generating article may comprise one or more airflow channels. The one or more airflow channels may extend along the length of the combustible heat-generating element. The one or more airflow channels may form part of the one or more airflow pathways of the heated aerosol-generating article. In other words, the combustible heat-generating element may be a non-blind combustible heat-generating element. As used herein, the term 'non-blind' is used to describe a combustible heat-generating element in which air drawn through the heated aerosol-generating article for inhalation by a user passes through one or more airflow channels along the combustible heat-generating element. This may facilitate convective heat transfer between the non-blind combustible heat-generating element and the liquid aerosol-forming substrate.

Where the combustible heat-generating element comprises one or more airflow channels, the heated aerosol-generating article may further comprise a non-combustible, substantially air impermeable, second barrier between the combustible heat-generating element and the one or more airflow channels of the combustible heat-generating element. The second barrier may facilitate isolation of the combustible heat-generating element from the one or more airflow pathways of the heated aerosol-generating article. The second barrier may substantially prevent or inhibit combustion and decomposition products formed during ignition and combustion of the combustible heat-generating element of aerosol-generating articles according to the invention from entering air drawn downstream along the one or more airflow channels.

The second barrier may be adhered or otherwise affixed to the combustible heat-generating element. The second barrier may comprise a second barrier coating provided on an inner surface of the one or more airflow channels. The second barrier may comprise a second barrier coating provided on the inner surface of the one or more airflow channels. The second barrier coating may be provided by insertion of a liner into the one or more airflow channels. For example, where the one or more airflow pathways comprise one or more airflow channels that extend through the interior of the combustible heat-generating element, a non-combustible, substantially air impermeable hollow tube may be inserted into each of the one or more airflow channels. Where the second barrier comprises a second barrier coating provided on an inner surface of the one or more airflow channels, the second barrier coating may be applied to the inner surface of the one or more airflow channels by any suitable method, such as the methods described in U.S. Pat. No. 5,040,551 and WO-A1-2013120855.

Depending upon the desired characteristics and performance of the heated aerosol-generating article, the second barrier may have a low thermal conductivity or a high thermal conductivity.

The second barrier may be formed from one or more suitable materials that are substantially thermally stable and non-combustible at temperatures achieved by the combustible heat-generating element during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where aerosol-generating articles according to the invention comprise a first barrier between a downstream end of the combustible heat-generating element and an upstream end of the aerosol-forming substrate and a second barrier between the combustible heat-generating element and one or more airflow channels along the combustible heat-generating element, the second barrier may be formed from the either the same material or a different material to the first barrier.

The heated aerosol-generating article may further comprise a heat-conducting element circumscribing at least a proximal portion of the combustible heat-generating element and at least a distal portion of the component arranged adjacent to the combustible heat-generating element. The heat-conducting element may facilitate transfer heat from the combustible heat-generating element to the adjacent component. The heat-conducting element may circumscribe at least a distal portion of the liquid retention medium. The heat-conducting element may circumscribe at least a distal portion of the heat diffuser.

The heat-conducting element may be substantially combustion-resistant. Suitable heat-conducting elements may include: metal foil wrappers or metal allow foil wrappers. The metal foil wrappers may include: aluminium foil wrappers, steel foil wrappers, iron foil wrappers and copper foil wrappers. The heat-conducting element may comprise a tube of aluminium.

The heated aerosol-generating article may comprise a heat conducting member arranged between the combustible heat-generating element and the liquid aerosol-forming substrate. Where the heated aerosol-generating article comprises a heat diffuser, the heat conducting member may be arranged between the combustible heat-generating element and the heat diffuser. The heat conducting member may be the first barrier, described above. The heated aerosol-generating article may comprise a heat conducting member and a first barrier. The heat conducting member may comprise similar material to the heat conducting element. The heated aerosol-generating article may comprise a heat conducting member and a heat conducting element. The provision of at least one of the heat-conducting element and the heat conducting member may facilitate conductive heat transfer between the combustible heat-generating element and the adjacent component.

The invention will be further described, by way of example only, with reference to the accompanying drawings in which:

FIG. 1 shows a schematic representation of a heated aerosol-generating article 2 in accordance with a first embodiment the present invention.

Figure 1:
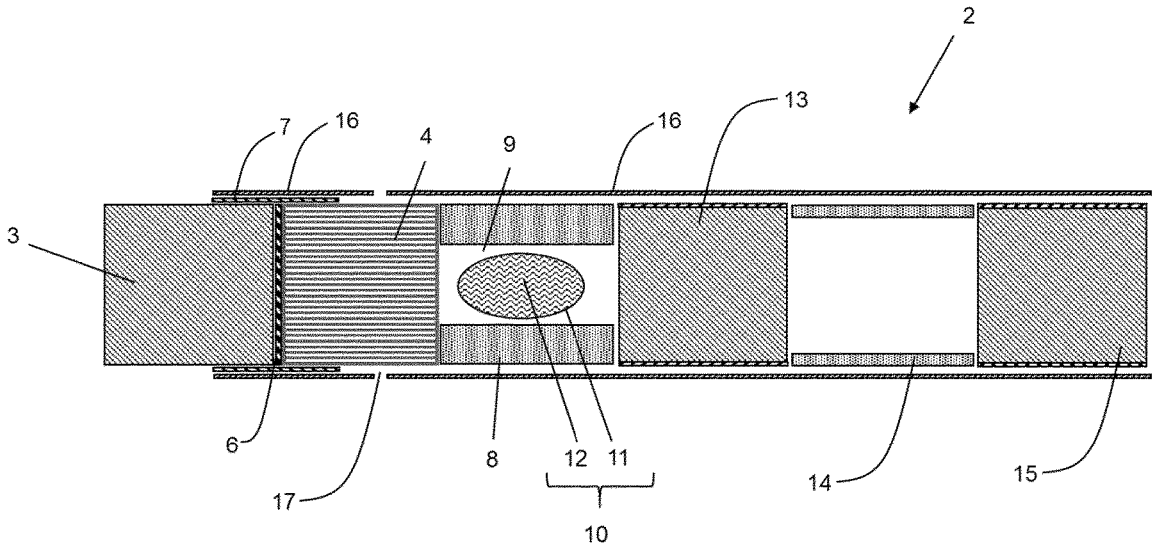
FIG. 1 shows a schematic representation of a first embodiment of a heated aerosol-generating article according to the present invention comprising a blind combustible heat-generating element.

The heated aerosol-generating article 1 comprises a combustible heat-generating element 3, a heat diffuser 4, a tubular liquid retention medium 8, a cylindrical aerosol-generation section having an aerosol-cooling element 13 and a transfer element 14, and a mouthpiece filter 15. These components are arranged co-axially and circumscribed by a wrapper 16. The heated aerosol-generating article is in the form of a substantially cylindrical rod and has a mouth end at the mouthpiece filter 15 and a distal end, opposite to the mouth end, at the combustible heat-generating element 3. The total length of the article 10 is 73 mm and it has an outer diameter of 7.2 mm.

The tubular liquid retention medium 8 comprises a lumen 9 and a frangible capsule 10 is located within a lumen 9 of the tubular liquid retention medium 8. The frangible capsule 10 comprises an outer shell 11 containing a liquid aerosol-forming substrate 12.

The combustible heat-generating element 3 comprises a substantially circularly cylindrical body of carbonaceous material, having a length of about 10 millimetres. The combustible heat-generating element 3 is a blind combustible heat-generating element. In other words, the combustible heat-generating element 3 does not comprise any air channels extending therethrough.

The heated aerosol-generating article 2 further comprises a heat diffuser 4. The heat diffuser 4 is a substantially cylindrical element formed from glass fibre. The heat diffuser may be made from other porous materials such as ceramic fibres, ceramic foams, or sintered metals. The heat diffuser 4 is arranged between the combustible heat-generating element 3 and the liquid retention medium 8. The heat diffuser 4 is in thermal contact with the combustible heat-generating element 3.

A non-combustible, substantially air impermeable first barrier 6 is arranged between the proximal end of the combustible heat-generating element 3 and a distal end of the heat diffuser 4. The first barrier 6 comprises a disc of aluminium foil. The first barrier 6 also forms a heat-conducting member between the combustible heat-generating element 3 and the heat diffuser 4, for conducting heat from the proximal face of the combustible heat-generating element 3 to the distal face of the heat diffuser 4.

A heat-conducting element 7 circumscribes a proximal portion of the combustible heat-generating element 3 and a distal portion of the heat diffuser 4. The heat-conducting element 7 comprises a tube of aluminium foil. The heat-conducting element 7 is in direct contact with the proximal portion of the combustible heat-generating element 3 and the heat diffuser 4.

The heated aerosol-generating article 2 further comprises a liquid retention medium 8 arranged at the proximal end of the heat diffuser 4. The liquid retention medium 8 comprises a cylindrical open-ended hollow tube of high retention material, such as PET fibres. The liquid retention medium 8 has a central lumen 9 extending centrally through the liquid retention medium 8 and aligned with the longitudinal axis of the heated aerosol-generating article.

The tubular liquid retention medium 8 has a length of 8 mm and is formed from fibrous cellulose acetate material. The liquid retention medium 8 has a capacity to absorb 35 microlitres of liquid. The lumen 9 of the tubular liquid retention medium 8 provides an air flow path through the liquid retention medium and also acts to locate the frangible capsule 10. The material of the liquid retention medium may be any other suitable fibrous or porous material.

The frangible capsule 10 is shaped as an oval spheroid and has the long dimension of the oval aligned with the axis of the lumen. The oval spheroid shape of the capsule 10 may mean that it is easier to break than if it was circular spherical in shape, but other shapes of capsule may be used. The capsule has an outer shell 11 comprising a gelatin based polymeric material surrounding a liquid aerosol-forming substrate.

The liquid aerosol-forming substrate 12 comprises propylene glycol, nicotine extract, and 20 weight percent water. A wide range of flavourants may be optionally added. A wide range of aerosol-formers may be used as alternative, or in addition to, propylene glycol. The capsule 10 has a long axis that is about 4 mm in length and contains a volume of about 33 microlitres of liquid aerosol-forming substrate.

The aerosol-cooling element 13 comprises a crimped and gathered sheet of polymeric material. The sheet of polymeric material is not densely packed and the aerosol-cooling element does not cause significant pressure drop in air passing through the section. The aerosol-cooling element has a length of about 18 mm, an outer diameter of about 7.12 mm, and an inner diameter of about 6.9 mm. In one embodiment, the aerosol-cooling element is formed from a sheet of polylactic acid having a thickness of 50 mm±2 mm. The sheet of polylactic acid has been crimped and gathered to define a plurality of channels that extend along the length of the aerosol-cooling element. The total surface area of the aerosol-cooling element is between 8000 $mm^2$ and 9000 $mm^2$, which is equivalent to approximately 500 $mm^2$ per mm length of the aerosol-cooling element. The specific surface area of the aerosol-cooling element is approximately 2.5 $mm^2/mg$ and it has a porosity of between 60% and 90% in the longitudinal direction. The polylactic acid is kept at a temperature of 160 degrees Celsius or less during use.

Porosity is defined herein as a measure of unfilled space in a rod including material such as an aerosol-cooling element. For example, if a diameter of the rod was 50% unfilled by the aerosol-cooling element, the porosity would be 50%. Likewise, a rod would have a porosity of 100% if the inner diameter was completely unfilled and a porosity of 0% if completely filled. The porosity may be calculated using known methods.

The transfer element 14 comprises a hollow tube of polymeric material having a length of about 18 mm, an outer diameter of about 7.12 mm, and an inner diameter of about 6.9 mm.

The aerosol-generating section may not comprise both the aerosol-cooling element and the transfer element. The aerosol-generating section may comprise one of the aerosol-cooling element and the transfer element.

The mouthpiece filter 15 has a length of 7 mm and is formed from cellulose acetate tow. Other suitable mouthpiece filters are known in the art.

The wrapper 16 is a non-porous wrapper. Suitable non-porous materials are known, for example polymeric films or hydrophobic papers. In some embodiments, a traditional cigarette paper may be used.

A plurality of air inlets 17 are arranged over the heat diffuser 4, proximal to the heat-conducting element 7, to enable ambient air to be drawn into the heated aerosol-generating article 2. The air inlets 17 comprise a plurality of perforations through the liquid impervious layer 16.

The heated aerosol-generating article 2 comprises an airflow path extending between the plurality of air inlets 17 and the mouthpiece filter 15. The heat diffuser 4 is arranged within the air flow path of the heated aerosol-generating article.

When a user draws on the mouthpiece 15 of the heated aerosol-generating article 2, ambient air is drawn into the heated aerosol-generating article 2 through the plurality of air inlets 17. The air drawn into the heated aerosol-generating article 2 flows through the heat diffuser 4 to the liquid retention medium 8, and from the liquid retention medium 8 to the cooling element 13, the spacer element 14 and the mouthpiece 15, where the air is delivered to the user for inhalation.

A method of using the heated aerosol-generating article 2 will be described with relation to the embodiment of FIG. 1.

Figure 2:
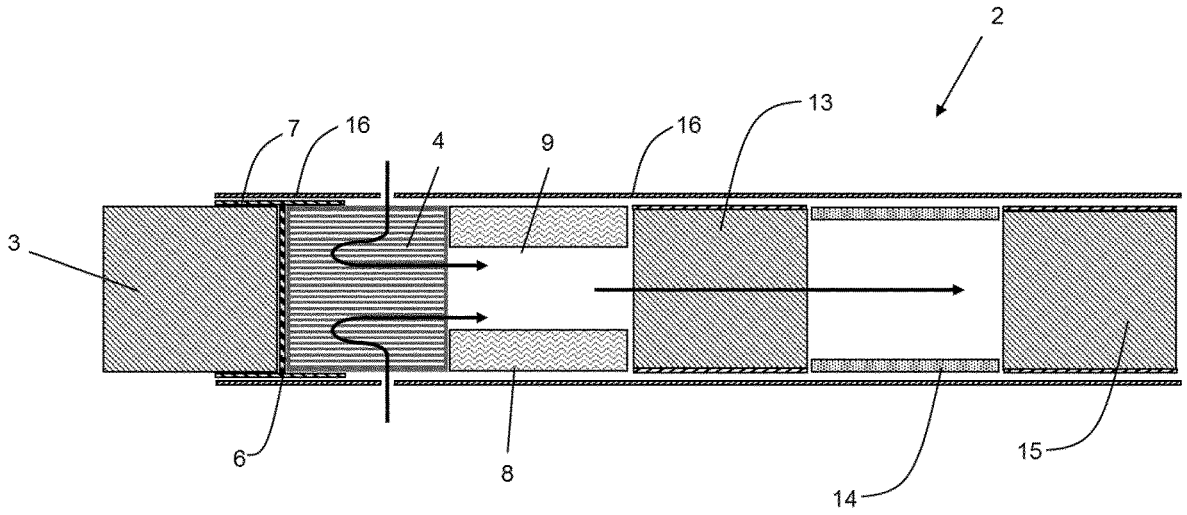
FIG. 2 shows the heated aerosol-generating article of FIG. 1 wherein the frangible capsule has been ruptured.

The first step is to release the liquid aerosol-forming substrate from its frangible capsule. This is achieved by squeezing the article in the region of the capsule between forefinger and thumb to apply an external force to rupture the frangible capsule. Once ruptured, the liquid aerosol-forming substrate is released onto and rapidly absorbed by the liquid retention medium. The article is thus primed and ready for ignition of the combustible heat-generating element, as shown in FIG. 2.

A user ignites the combustible heat-generating element 3 by exposing the combustible heat-generating element 3 to an external heat source, such as a lighter. The combustible heat-generating element 3 begins to combust and generate heat. Heat is transferred from the combustible heat-generating element 3 to the heat diffuser 4, via conduction through the heat-conducting member 6 and the heat-conducting element 7. When the user draws on the mouthpiece 15, ambient air is drawn into the aerosol-generating article 2, through air inlets 17. The air drawn into the aerosol-generating article 2 is drawn directly into the heat diffuser 4. The air is heated as it is drawn proximally through the heat diffuser 4 and into the liquid retention medium 8. The heated air heats the liquid retention medium 8, heating the liquid aerosol-forming substrate 12, and volatile components of the heated aerosol-forming substrate 12 are vapourised and entrained in the heated air. The entrained vapour is drawn out of the liquid retention medium 8 towards the mouthpiece 15. As the vapour is drawn towards the mouthpiece 15, through the aerosol-cooling element 13 and spacer element 14, the vapour cools to form an aerosol. The aerosol is draw into the mouthpiece 15 and out of the proximal end of the article 2 to be delivered to the user for inhalation.

It will be appreciated that the substantially air-impermeable first barrier 6 inhibits air being drawn through the combustible heat-generating element 3 and into the heat diffuser 4. As such, the first barrier 6 substantially isolates the airflow pathway of the heated aerosol-generating article 2 from the combustible heat-generating element 3.

Figure 3:
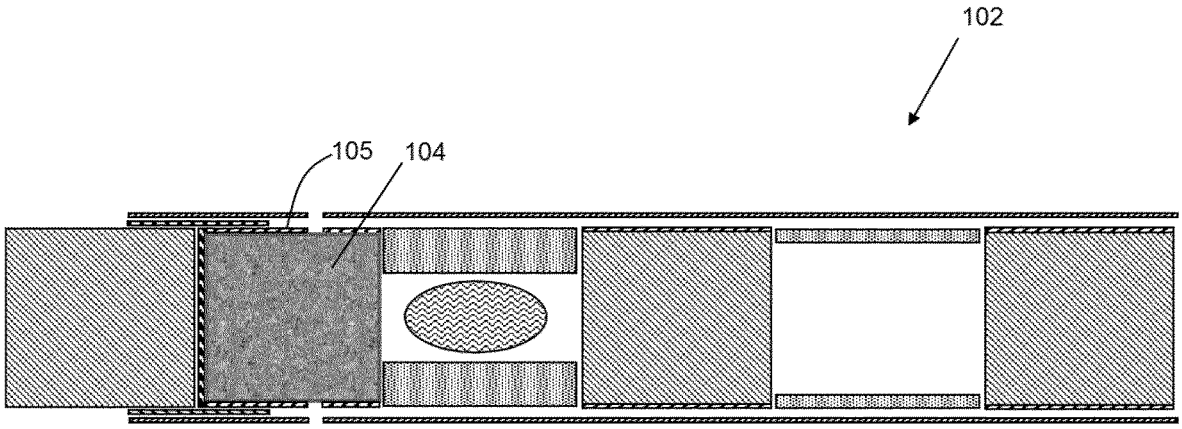
FIG. 3 shows a schematic representation of a second embodiment of a heated aerosol-generating article according to the present invention comprising a heat diffuser in the form of a solid aerosol-forming substrate.

FIG. 3 illustrates a heated aerosol-generating article 102 according to a second embodiment of the present invention. The heated aerosol-generating article 102 is identical to the article 2 described in relation to FIG. 1, with the difference that the glass fibre heat diffuser 4 has been replaced by a cylindrical body of solid aerosol-forming substrate 104 wrapped in a filter plug wrap 105. Airflow through the article 102 is also identical to the airflow through the article 2 described in relation to FIG. 1, with the difference being that as the air is heated as it is being drawn proximally through the heat diffuser 4 and into the liquid retention medium 8, volatile components of the heated solid aerosol-forming substrate 104 are vapourised and entrained in the heated air.

The specific embodiments described above are intended to illustrate the invention. However, other embodiments may be made without departing from the scope of the invention as defined in the claims, and it is understood that the specific embodiments described above are not intended to be limiting.

The invention claimed is:

1. A heatable aerosol-generating article, comprising:

a plurality of components assembled in the form of a rod, the article having a mouth end and a distal end upstream from the mouth end;

a combustible heat-generating element disposed at the distal end of the article and being configured to heat air drawn into the article;

a liquid aerosol-forming substrate disposed downstream of the combustible heat-generating element, the liquid aerosol-forming substrate being releasably contained within a frangible capsule, and the liquid aerosol-forming substrate comprising a nicotine solution and at least one aerosol-former;

a liquid retention medium configured to retain the liquid aerosol-forming substrate within the article, wherein the frangible capsule is disposed within the liquid retention medium; and a heat diffuser being in thermal contact with the combustible heat-generating element and disposed between the combustible heat-generating element and the liquid aerosol-forming substrate, air entering the article through an inlet flowing through the heat diffuser to be heated before flowing over the liquid aerosol-generating substrate to form an aerosol.

2. The heatable aerosol-generating article according to claim 1, wherein the liquid retention medium is in the form of a tube having a lumen and the frangible capsule is disposed within the lumen of the tube.

3. The heatable aerosol-generating article according to claim 1, wherein the liquid retention medium comprises an absorbent polymeric material.

4. The heatable aerosol-generating article according to claim 1, further comprising a cooling section disposed downstream from the liquid aerosol-forming substrate.

5. The heatable aerosol-generating article according to claim 1, wherein the at least one aerosol-former comprises at least one polyhydric alcohol.

6. The heatable aerosol-generating article according to claim 1, wherein the liquid aerosol-forming substrate comprises between 10 weight percent and 25 weight percent water, an aerosol former, and at least one flavourant.

7. The heatable aerosol-generating article according to claim 1, further comprising a mouthpiece filter disposed at the mouth end of the article.

8. The heatable aerosol-generating article according to claim 1, wherein the plurality of components are assembled within a wrapper, the wrapper being formed from a sheet of liquid-impervious material.

9. The heatable aerosol-generating article according to claim 8, wherein the wrapper is a sheet of polymeric material, a sheet of treated paper, or a sheet of metallic foil.

10. The heatable aerosol-generating article according to claim 1, wherein the heat diffuser comprises a solid aerosol-forming substrate, the article thereby being configured to generate the aerosol from both the solid aerosol-forming substrate and the liquid aerosol-forming substrate.

11. The heatable aerosol-generating article according to claim 10, wherein the solid aerosol-forming substrate is homogenised tobacco material.

* * * * *